US011214949B2

(12) United States Patent
Gonzales

(10) Patent No.: US 11,214,949 B2
(45) Date of Patent: Jan. 4, 2022

(54) TOILET DEODORANT CONTAINER

(71) Applicant: Gilbert Gonzales, Fremont, CA (US)

(72) Inventor: Gilbert Gonzales, Fremont, CA (US)

( * ) Notice: Subject to any disclaimer, the term of this patent is extended or adjusted under 35 U.S.C. 154(b) by 0 days.

(21) Appl. No.: 16/852,494

(22) Filed: Apr. 19, 2020

(65) Prior Publication Data

US 2021/0324619 A1 Oct. 21, 2021

(51) Int. Cl.
*E03D 9/03* (2006.01)

(52) U.S. Cl.
CPC ..... *E03D 9/033* (2013.01)

(58) Field of Classification Search
CPC ..... E03D 9/032; E03D 9/033
USPC ..... 4/223, 231
See application file for complete search history.

(56) References Cited

U.S. PATENT DOCUMENTS 4,168,551 A * 9/1979 Hautmann ..... E03D 9/032 4/223
4,261,957 A * 4/1981 Schimanski ..... E03D 9/032 248/213.2
7,603,726 B2 * 10/2009 Sawalski ..... B65D 83/20 4/223
2011/0173742 A1 * 7/2011 Leo ..... E03D 9/032 4/223
2013/0112830 A1 * 5/2013 Knorr ..... E03D 9/00 248/304
2016/0251840 A1 * 9/2016 Zuechner ..... E03D 9/032 4/231
2019/0218761 A1 * 7/2019 Reger ..... E03D 9/032

* cited by examiner

*Primary Examiner* — Huyen D Le
(74) *Attorney, Agent, or Firm* — The Iwashko Law Firm, PLLC; Lev Ivan Gabriel Iwashko

(57) ABSTRACT

A toilet deodorant container, including a main body to store a toilet deodorant upon an interior surface therein, at least one water aperture disposed on at least a portion of the main body to facilitate movement of water therethrough, and a hook assembly disposed on at least a portion of a side of the main body to connect via an outer surface of the hook assembly to a toilet bowl to suspend the main body into the toilet bowl.

4 Claims, 1 Drawing Sheet

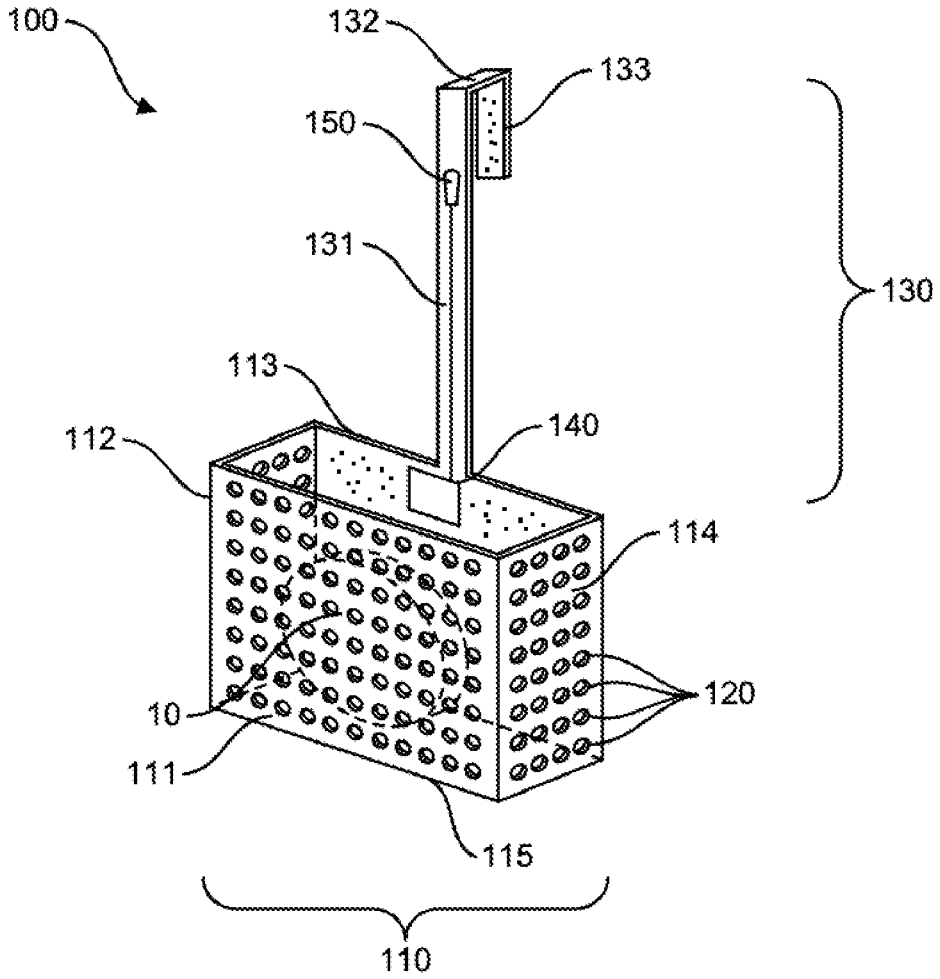
100
132
133
150
131
130
113
140
112
114
120
10
111
115
110

TOILET DEODORANT CONTAINER

BACKGROUND

1. Field

The present general inventive concept relates generally to a container, and particularly, to a toilet deodorant container.

2. Description of the Related Art

Bathroom cleanliness is an essential component of household sanitation. However, a toilet tends to accumulate odors. Without proper air fresheners or cleaning supplies, the toilet can emanate a foul scent. The odor can be unbearable for people living in the home as well as for guests who want to use the bathroom.

Generally, methods to remove the odors includes using a deodorant spray and/or inserting a toilet deodorant into a tank of the toilet. Unfortunately, the toilet deodorant is constantly submerged in water in the tank, such that the toilet deodorant breaks down and saturates the water with cleaning particles and/or deodorant particles contained in the toilet deodorant. Additionally, the toilet deodorant is overused requiring a user to replenish the toilet deodorant quickly.

Therefore, there is a need for a toilet deodorant container that prevents the water from being saturated and facilitates contact from the water when needed.

SUMMARY

The present general inventive concept provides a toilet deodorant container.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a toilet deodorant container, including a main body to store a toilet deodorant on an interior surface therein, at least one water aperture disposed on at least a portion of the main body to facilitate movement of water therethrough, and a hook assembly disposed on at least a portion of a side of the main body to connect via an outer surface of the hook assembly to a toilet bowl to suspend the main body into the toilet bowl.

The interior surface of the main body and the outer surface of the hook assembly may each be a rough surface.

The interior surface of the main body and the outer surface of the hook assembly may each be a textured surface.

The toilet deodorant container may further include an air dispenser unit disposed on at least a portion of the main body to blow air into an interior of the main body in response to detection of a predetermined moisture level.

BRIEF DESCRIPTION OF THE DRAWINGS

These and/or other features and utilities of the present generally inventive concept will become apparent and more readily appreciated from the following description of the embodiments, taken in conjunction with the accompanying drawings of which:

FIG. 1 illustrates a top isometric view of a toilet deodorant container, according to an exemplary embodiment of the present general inventive concept.

DETAILED DESCRIPTION

Various example embodiments (a.k.a., exemplary embodiments) will now be described more fully with reference to the accompanying drawings in which some example embodiments are illustrated. In the FIGURES, the thicknesses of lines, layers and/or regions may be exaggerated for clarity.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

LIST OF COMPONENTS

Toilet Deodorant Container 100
Main Body 110
First Side 111
Second Side 112
Third Side 113
Fourth Side 114
Base 115
Water Apertures 120

Hook Assembly 130
First Portion 131
Second Portion 132
Third Portion 133
Air Dispenser Unit 140
Power Source 150

FIG. 1 illustrates a top isometric view of a toilet deodorant container 100, according to an exemplary embodiment of the present general inventive concept.

The toilet deodorant container 100 may be constructed from at least one of metal, plastic, ceramic, wood, glass, and rubber, etc., but is not limited thereto.

The toilet deodorant container 100 may include a main body 110, a plurality of water apertures 120, a hook assembly 130, an air dispenser unit 140, and a power source 150, but is not limited thereto.

Referring to FIG. 1, the main body 110 is illustrated to have a rectangular prism shape. However, the main body 110 may be rectangular, circular, pentagonal, hexagonal, octagonal, or any other shape known to one of ordinary skill in the art, but is not limited thereto.

The main body 110 may include a first side 111, a second side 112, a third side 113, a fourth side 114, and a base 115, but is not limited thereto.

The main body 110 may store a toilet deodorant 10 upon an interior surface therein. Moreover, the interior surface of the main body 110 may be covered by a rough surface (i.e. epoxy or non-slip material) and/or a textured surface, such as a plurality of bubbled protrusions extending away therefrom. As such, the interior surface of the main body 110 may prevent the toilet deodorant 10 from moving therein.

Referring again to FIG. 1, a length of the first side 111 and a length of the third side 113 may be greater than a length of the second side 112 and a length of the fourth side 114. Furthermore, a length of the base 115 may be equivalent to the length of the first side 111 and/or the length of the third side 113. Also, a width of the base 115 may be equivalent to the length of the second side 112 and the length of the fourth side 114.

Additionally, a height of the main body 110 may be greater than a height of the toilet deodorant 10 therein. In other words, the height of the main body 110 may prevent the toilet deodorant 10 from falling out therefrom.

Referring again to FIG. 1, the plurality of water apertures 120 are illustrated to be disposed on at least a portion of the first side 111, the second side 112, and/or the fourth side 114. However, in addition, the plurality of water apertures 120 may be disposed on at least a portion of the third side 113 and/or the base 115.

Although, the plurality of water apertures 120 are illustrated to be a plurality, the plurality of water apertures 120 may be a single water aperture 120 disposed on the first side 111, the second side 112, the third side 113, the fourth side 114, and/or the base 115.

Each of the plurality of water apertures 120 may facilitate movement of water therethrough, such that the water contacts at least a portion of the toilet deodorant 10.

The hook assembly 130 may include a first portion 131, a second portion 132, and a third portion 133, but is not limited thereto.

A first end of the first portion 131 may be disposed on at least a portion of the third side 113 of the main body 110. Moreover, the first portion 131 may extend away from the third side 113 of the main body 110 in a first direction.

A first end of the second portion 132 may be perpendicularly disposed away from a second end of the first portion 131 with respect to a second direction. An end of the third portion 133 may be perpendicularly disposed away from a second end of the second portion 132 with respect to a third direction, such that the first portion 131 and/or the third portion 133 may be in parallel.

Furthermore, a length of the first portion 131 may be greater than a length of the third portion 133 to allow the hook assembly 130 to be connected via an outer surface of the hook assembly 130 to a toilet bowl (not illustrated) to suspend the main body 110 into the toilet bowl. For example, the length of the first portion 131 may be at least four times the length of the third portion 133. Also, the length of the first portion 131 may be of a predetermined length to allow the main body 110 to be immersed in the water from the toilet bowl during flushing. In other words, the main body 110 may be covered from the water during flushing, such that the toilet deodorant 10 may dispense cleaning particles and/or deodorant particles into the toilet bowl.

Moreover, the outer surface of the hook assembly 130 may be covered by a rough surface (i.e. epoxy or non-slip material) and/or a textured surface, such as a plurality of bubbled protrusions extending away therefrom. As such, the outer surface of the hook assembly 130 may prevent movement while disposed on the toilet bowl.

The air dispenser unit 140 may include a sensor and a fan, but is not limited thereto.

The air dispenser unit 140 may be disposed on at least a portion of the main body 110 and/or the hook assembly 130. The sensor may detect a moisture level on an interior surface of the main body 110. More specifically, the sensor may detect the moisture level of the main body 110 based on a moisture level of the toilet deodorant 10.

The fan may at least partially protrude into the main body 110 and/or be directed to blow air toward the base 115, such that air from the fan envelops the interior of the main body 110. As such, the fan may dry the main body 110 and/or the toilet deodorant 10. In particular, the fan may blow air in response to the sensor detecting the moisture level of the main body 110 exceeding a predetermined level. Therefore, the air dispenser unit 140 may prevent the toilet deodorant 10 from overuse.

The power source 150 may include a battery and a solar cell, but is not limited thereto.

The power source 150 may be disposed on at least a portion of the hook assembly 130 and may be electrically connected to the air dispensing unit 140 to send power to the air dispensing unit 140. Alternatively, the power source 150 may be disposed on at least a portion of the main body 110.

The present general inventive concept may include a toilet deodorant container 100, including a main body 110 to store a toilet deodorant 10 upon an interior surface therein, at least one water aperture 120 disposed on at least a portion of the main body 110 to facilitate movement of water therethrough, and a hook assembly 130 disposed on at least a portion of a side of the main body 110 to connect via an outer surface of the hook assembly 130 to a toilet bowl to suspend the main body 110 into the toilet bowl.

The interior surface of the main body 110 and the outer surface of the hook assembly 130 may each be a rough surface.

The interior surface of the main body 110 and the outer surface of the hook assembly 130 may each be a textured surface.

The toilet deodorant container 100 may further include an air dispenser unit 140 disposed on at least a portion of the main body 110 to blow air into an interior of the main body 110 in response to detection of a predetermined moisture level.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

The invention claimed is:

1. A toilet deodorant container, comprising:

a main body to store a toilet deodorant upon an interior surface therein;

a plurality of water apertures disposed on at least a portion of the main body to facilitate movement of water therethrough, such that a portion of the plurality of water apertures are disposed on at least one side of the main body in an arrangement of linearly arranged columns and linearly arranged rows;

a hook assembly disposed on at least a portion of a side of the main body to connect via an outer surface of the hook assembly to a toilet bowl to suspend the main body into the toilet bowl; and an air dispenser unit disposed on at least a portion of the main body to blow air into an interior of the main body in response to detection of a predetermined moisture level.

2. The toilet deodorant container of claim 1, wherein the interior surface of the main body and the outer surface of the hook assembly are each a rough surface.

3. The toilet deodorant container of claim 1, wherein the interior surface of the main body and the outer surface of the hook assembly are each a textured surface.

4. A toilet deodorant container, comprising:

a main body to store a toilet deodorant upon an interior surface therein;

at least one water apertures disposed on at least a portion of the main body to facilitate movement of water therethrough;

a hook assembly disposed on at least a portion of a side of the main body to connect via an outer surface of the hook assembly to a toilet bowl to suspend the main body into the toilet bowl; and an air dispenser unit disposed on at least a portion of the main body to blow air into an interior of the main body in response to detection of a predetermined moisture level.

* * * * *